US005850961A

United States Patent [19]

Braun et al.

[11] Patent Number: 5,850,961

[45] Date of Patent: Dec. 22, 1998

[54] QUICK EXHAUST REMOTE TRIGGER VALVE FOR FASTENER DRIVING TOOL

[75] Inventors: Phillip M. Braun, Exeter; David Smith, Warwick, both of R.I.

[73] Assignee: Stanley-Bostitch, Inc., East Greenwich, R.I.

[21] Appl. No.: 777,015

[22] Filed: Jan. 7, 1997

[51] Int. Cl.[6] ..... B25C 1/04

[52] U.S. Cl. ..... 227/130; 227/8

[58] Field of Search ..... 227/8, 130

[56] References Cited

U.S. PATENT DOCUMENTS

| | | | |
|---|---|---|---|
| 3,272,267 | 9/1966 | Langas . | |
| 3,436,004 | 4/1969 | Morabito et al. . | |
| 4,284,223 | 8/1981 | Salcido . | |
| 4,736,879 | 4/1988 | Yamada . | |
| 5,083,694 | 1/1992 | Lemos | 227/8 |
| 5,476,205 | 12/1995 | Canlas et al. | 227/130 |
| 5,509,489 | 4/1996 | Lower, Jr. . | |
| 5,669,542 | 9/1997 | White | 227/130 |
| 5,671,880 | 9/1997 | Ronconi | 227/8 |
| 5,683,024 | 11/1997 | Eminger et al. | 227/8 |

FOREIGN PATENT DOCUMENTS

| | | |
|---|---|---|
| 684110A1 | 11/1995 | European Pat. Off. . |
| 2902358 | 7/1980 | Germany . |
| 3222949A1 | 6/1983 | Germany . |

*Primary Examiner*—Scott A. Smith
*Assistant Examiner*—John Paradiso
*Attorney, Agent, or Firm*—Cushman Darby & Cushman IP Group of Pillsbury Madison & Sutro L.L.P.

[57] ABSTRACT

A remotely actuated fastener driving tool includes a housing defining a fastener drive track, a fastener driving element carried by the housing for movement within the drive track through successive cycles of operation. A drive piston is operatively connected with the fastener driving element. A pilot pressure operated main valve is movable from a normally closed position into an opened position allowing a supply of air under pressure to be communicated with the drive piston to effect the movement of the drive piston and fastener driving element. A magazine assembly is carried by the housing for receiving a supply of fasteners and feeding successive fasteners into the drive track. Valve structure is provided which includes a valve member carried by the housing and is constructed and arranged to move from a normal, inoperative position into an operative position to initiate the movement of the main valve from its closed position to its opened position. The valve structure is constructed and arranged to be coupled to a remotely located source of air under pressure such that when air pressure is applied to the valve structure, the valve member is biased to the inoperative position thereof in sealing relation with an exhaust path defined by the valve structure, and when the air pressure is relieved from the valve structure, the valve member moves to the operative position thereof thereby opening the exhaust path permitting pilot pressure associated with the main valve to exhaust through the exhaust path initiating the fastener driving stroke.

9 Claims, 3 Drawing Sheets

QUICK EXHAUST REMOTE TRIGGER VALVE FOR FASTENER DRIVING TOOL

BACKGROUND OF THE INVENTION

This invention relates to fastener driving tools and, more particularly, to portable fastener driving tools having pressure valving permitting the tool to operate remotely.

The type of portable fastener driving tool hereto contemplated typically includes a fastener driving element or driver which is mounted within a drive track within which successive fasteners are fed. The driver is mounted for movement through repetitive cycles, each of which includes a drive stroke during which the fastener is moved out of the drive track into the work piece and a return stroke. The fastener driving element is fixedly connected with a piston which is mounted within a cylinder for movement through a drive stroke and a return stroke with the fastener driving element. The piston is driven by compressed air applied to an operative surface of the piston. Generally, actuating of the tool occurs upon manually actuating a trigger valve.

There are certain circumstances when it is desirable to actuate the tool remotely. One approach to remote tool actuation is to provide a pneumatic cylinder and a sling secured to the trigger. The cylinder moves the sling vertically which moves the trigger. This type of device is used for slow applications and is often used with a contact trip arm. In operation, the cylinder is retracted and the tool is lowered. When the contact trip comes into contact with the work surface, the tool is cycled. An advantage of this arrangement is that no modification of the tool is required, but a major disadvantage is that the arrangement increases the cost of components, has slow cycle rates and higher maintenance costs.

Another method of remote cycling a tool is to remove the hand operated trigger valve and replace it with a hollow plug. The plug is coupled to a normally opened 3-way solenoid or pilot operated signal valve. The advantage to this arrangement is low cost, no tool modification and the requirement of only a few parts. A disadvantage of this arrangement is that a large volume of air must be exhausted through the normally opened 3-way valve, thus not allowing the tool to perform at its peak cycle rate.

SUMMARY OF THE INVENTION

An object of the present invention is to provide a fastener driving tool which includes a quick exhaust trigger valve for remote operation of the tool permitting the main valve to exhaust at the tool which allows the tool to cycle at its maximum performance rate.

In accordance with the principles of the present invention, this objective is obtained by providing a remotely actuated fastener driving tool including a housing defining a fastener drive track, a fastener driving element carried by the housing for movement within the drive track through successive cycles of operation, each of which includes a fastener driving stroke and a return stoke. A drive piston is operatively connected with the fastener driving element for movement therewith. A pilot pressure operated main valve is movable from a normally closed position into an opened position allowing a supply of air under pressure to be communicated with the drive piston to initiate and effect the movement of the drive piston and fastener driving element through the fastener driving stroke thereof. A magazine assembly is carried by the housing for receiving a supply of fasteners and feeding successive fasteners into the drive track in a position to be driven into a work piece during successive fastener driving strokes of the fastener driving element. Valve structure is provided which includes a valve member carried by the housing constructed and arranged to move from a normal, inoperative position into an operative position to initiate the movement of the main valve from its closed position to its opened position. The valve structure is constructed and arranged to be coupled to a remotely located source of air under pressure such that when air pressure is applied to the valve structure, the valve member is biased to the inoperative position thereof in sealing relation with an exhaust path defined by the valve structure, and when the air pressure is relieved from the valve structure, the valve member moves to the operative position thereof thereby opening the exhaust path permitting pilot pressure associated with the main valve to exhaust through the exhaust path initiating the fastener driving stroke.

Another object of the invention is to provide a quick exhaust valve structure for a remotely actuated fastener driving tool. The tool includes a housing defining a fastener drive track and having a portion defining a reservoir chamber for storing supply air under pressure. A fastener driving element is carried by the housing for movement within the drive track through successive cycles of operation, each of which includes a fastener driving stroke and a return stoke. A drive piston is operatively connected with the fastener driving element for movement therewith. A pilot pressure operated main valve is movable from a normally closed position into an opened position allowing supply air to be communicated with the drive piston to initiate and effect the movement of the drive piston and fastener driving element through the fastener driving stroke thereof. A magazine assembly is carried by the housing for receiving a supply of fasteners and feeding successive fasteners into the drive track in a position to be driven into a work piece during successive fastener driving strokes of the fastener driving element.

The valve structure includes a valve housing constructed and arranged to be carried by the housing; a valve member mounted for movement within the valve housing so as to be movable between a normal, inoperative position and an operative position; an exhaust path defined in the valve housing; and a connector carried by the valve housing and in fluid communication with the valve member. The connector is constructed and arranged to be coupled to a remotely located source of air under pressure such that when the valve structure is carried by the tool and air pressure is applied to the valve structure through the connector, the valve member is biased to the inoperative position thereof in sealing relation with the exhaust path, and when the air pressure is relieved from the valve structure through the connector, the valve member moves to the operative position thereof thereby opening the exhaust path permitting pilot pressure associated with the main valve to exhaust through the exhaust path, initiating the fastener driving stroke.

Another object of the present invention is the provision of a device of the type described, which is simple in construction, effective in operation and economical to manufacture and maintain.

These and other objects of the present invention will become more apparent during the course of the following detailed description and the appended claims.

The invention may be best understood with reference to the accompanying drawings wherein an illustrative embodiment is shown.

DETAILED DESCRIPTION OF THE INVENTION

Figure 1:
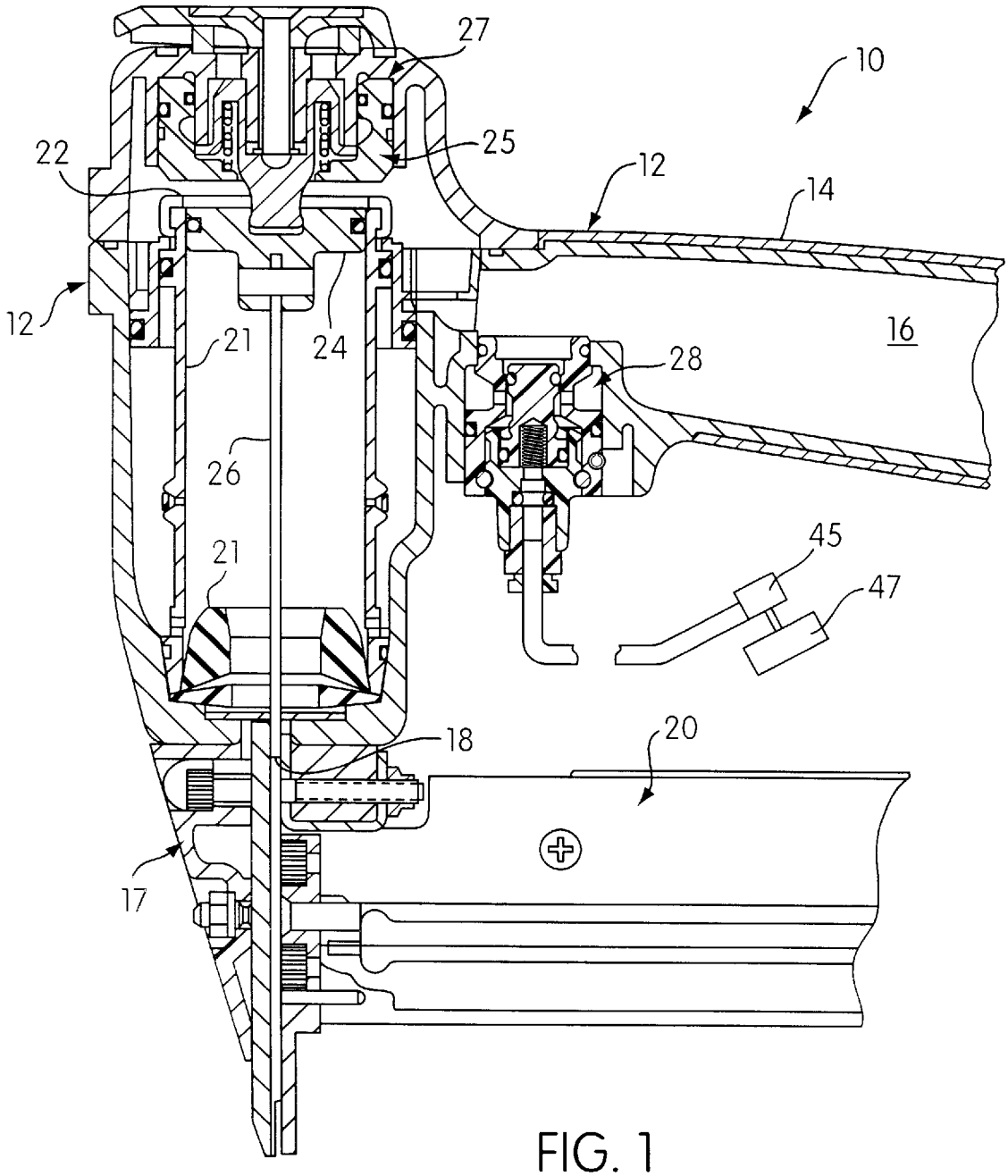
FIG. 1 is a side elevational view, with parts in section, of a pneumatically operated fastener driving tool including a quick exhaust trigger valve provided in accordance with the principles of the present invention.

Referring now more particularly to the drawings, a pneumatically operated fastener driving device, generally indicated at 10, is shown in FIG. 1, which embodies the principles of the present invention. The device 10 includes the usual housing assembly, generally indicated at 12, which includes a hand grip portion 14 of hollow configuration which constitutes a reservoir chamber 16 for supply air under pressure coming from a source which is communicated therewith. The tool housing assembly 12 further includes the usual nose piece 17 defining a fastener drive track 18 which is adapted to receive laterally therein the leading fastener from a package of fasteners mounted within a fastener magazine, generally indicated at 20. The magazine is of conventional construction and operation.

The tool housing assembly 12 includes a main body portion including a cylinder 21 therein which has its upper end 22 disposed in communicating relation with the reservoir chamber 16. A piston 24 is slidably sealing mounted in the cylinder for movement through repetitive cycles each of which includes a drive stroke and a return stroke. A fastener driving element 26 is operatively connected to the piston 24 and is slidably mounted within the drive track 18 and movable by the piston 24 through a drive stroke in response to the drive stroke of the piston, during which the fastener driving element 26 engages a fastener within the drive track 18 and moves the same longitudinally outwardly into a workpiece, and a return stroke in response to the return stroke of the piston.

In the conventional manner, a main valve, generally indicated at 25, is provided for controlling communication of the supply air to the upper end of the cylinder 21 to effect the driving movement of the piston 24 and the fastener driving element 26. The main valve 25 is pilot pressure operated and the pilot pressure chamber 27 thereof is under the control of an exhaust valve structure, generally indicated at 28. Means is provided within the tool housing assembly 12 to effect the return stroke of the piston 24. For example, such means may be in the form of a conventional plenum chamber return system such as disclosed in U.S. Pat. No. 3,708,096, the disclosure of which is hereby incorporated by reference into the present specification.

Figure 2:
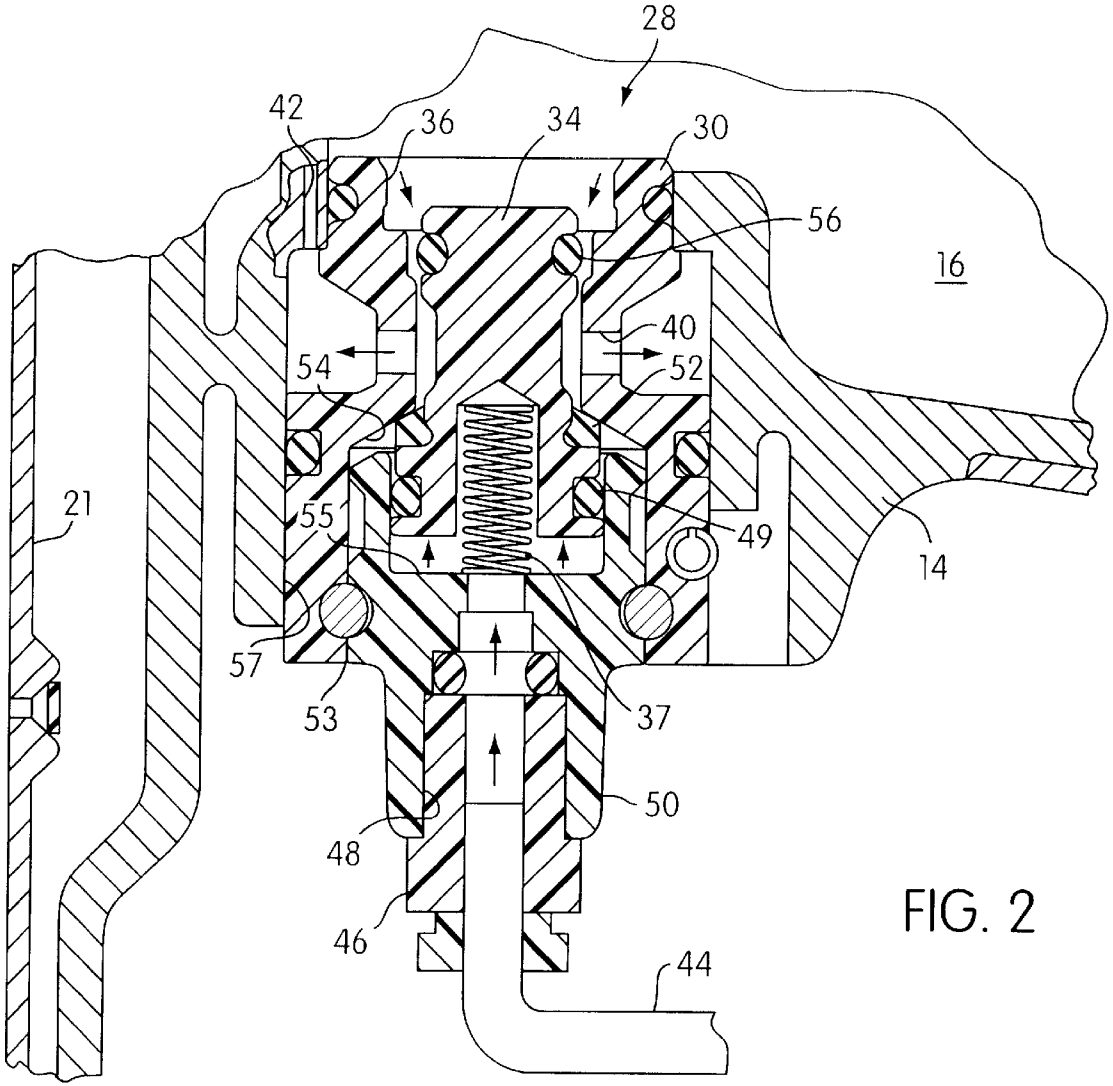
FIG. 2 is an enlarged sectional view of the quick exhaust trigger valve of FIG. 1, shown with a valve member thereof in an inoperative position.
Figure 3:
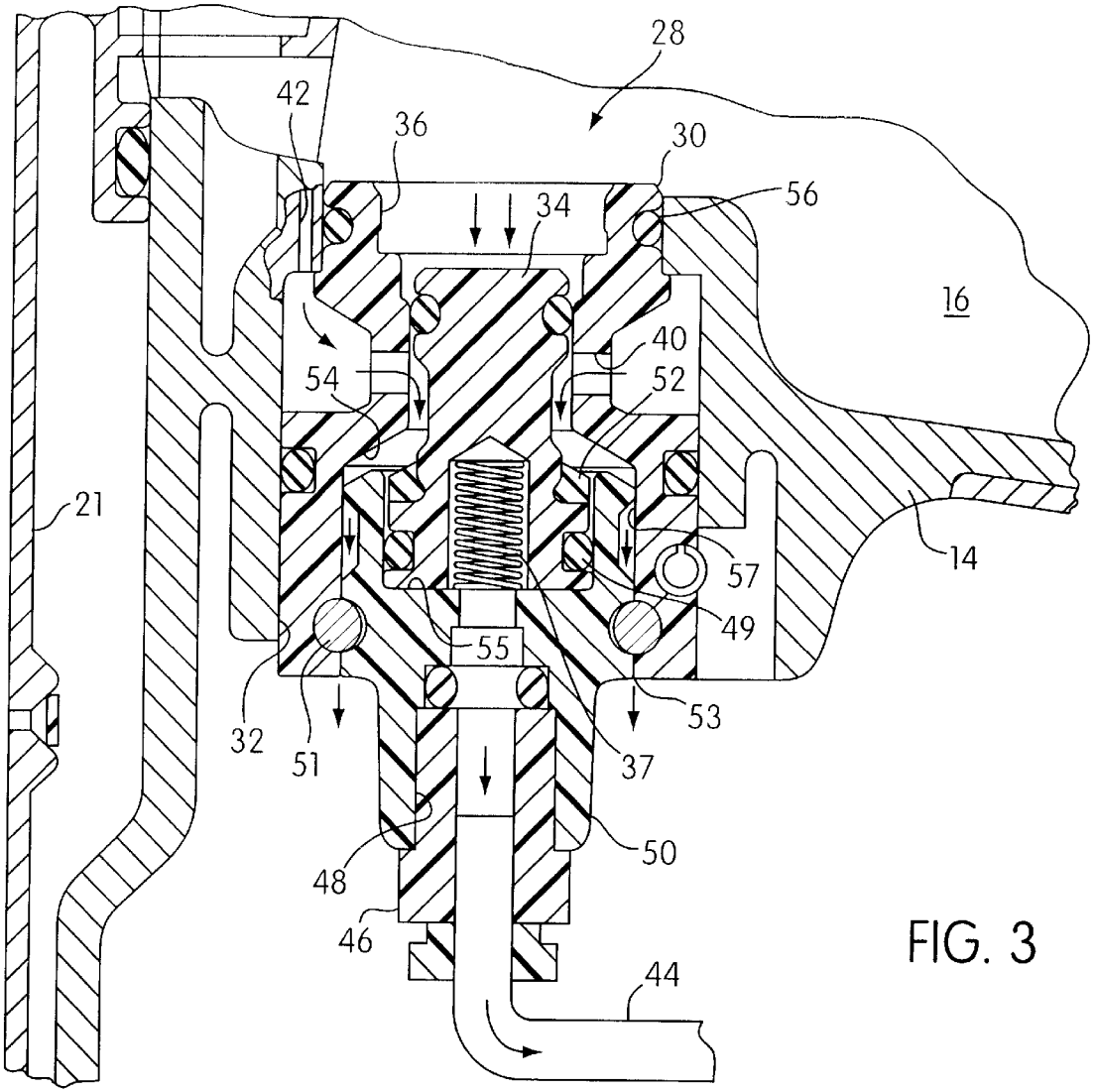
FIG. 3 is an enlarged sectional view of the quick exhaust trigger valve of FIG. 1, shown with a valve member thereof in an operative position.

In accordance with the principles of the present invention, the exhaust valve structure 28 is constructed and arranged to permit actuation of the tool remotely. With reference to FIGS. 2 and 3, the valve structure 28 includes a valve housing 30 sealingly engaged within a recess 32 formed in the handle portion 14 of the tool housing assembly 12. Mounted within the valve housing 30 is a tubular valve member 34. The valve member 34 is resiliently biased upwardly by a spring 37 and air pressure via line 44 into a normally inoperative position (FIG. 2), wherein a supply of air under pressure within the hollow handle portion 14 of the tool housing assembly 12 is enabled to pass through an opening 36 in the valve housing 30 in and around the tubular valve member 34 through the central openings 40 in the valve housing 30 and into a passage 42, which communicates with the pilot pressure chamber 27 for the main valve 25. In this position, seal 52 seals the exhaust path 53. When the pilot pressure chamber 27 is exposed to high pressure, the main valve 25 is in a closed position. The main valve 25 is pressure biased to move into an opened position when the pressure in the pilot pressure chamber 27 is relieved. The pilot pressure is relieved when the tubular valve member 34 moves from the inoperative position into an operative position (FIG. 3) discontinuing the communication of pressure in the reservoir chamber 16 with the pilot pressure chamber 27 and exhausting pressure in the pilot pressure chamber 27, to atmosphere. This movement is under the control of pressure supplied by the pressure line 44, which is coupled to a conventional 3-way, normally open valve 45, which in turn is coupled to a source 47 of air under pressure. The pressure line 44 is coupled to the valve member 34 via a conventional quick connect type fitting 46. In the illustrated embodiment, the fitting 46 is press-fitted into a bore 48 defined in lower valve housing portion 50. Other conventional fittings such as threaded fittings may be employed, when the bore 48 is threaded.

As shown in FIG. 2, the valve member 34 includes a lower portion having a peripheral seal 49 mounted within a control chamber 55 which serves to control movement of the valve member 34 via air pressure through line 44. Pressure via line 44 works with the bias of the spring 37 to maintain the valve member 34 in its inoperative position. In this position, the central seal 52 engages an annular valve seat 54 on the valve housing 30 to prevent pressure within passage 42 and openings 40 from escaping to atmosphere beyond the outer periphery of the valve housing portion 50 and through the exhaust path 53. Thus, as shown in FIGS. 2 and 3, the large diameter portion of the valve housing portion 50 is received in bore 57 of valve housing 30. The exhaust path 53 is defined between the outer periphery of large diameter portion of the valve housing portion 50 and the inner periphery of the valve housing 30. The valve housing portion 50 is coupled to the valve housing 30 via pins 51.

When the pressure in line 44 is vented through the 3-way valve, the supply of pressure within the control chamber 55 is dumped to atmosphere through the pressure line 44 causing the tubular valve member 34 to move downwardly to the operative position thereof (FIG. 3). This movement causes the seal 52 to move out of sealing relation. Thus, the supply pressure within the reservoir chamber 16 is sealed from passage 42 via O-ring 56 on valve member 34 and passage 42 is communicated to atmosphere via the opened exhaust path 53. In this way, the supply pressure from chamber 16 acts on the valve member 34 to maintain the valve member in its operative position. At the same time, the pressure within passage 42 and openings 40 is relieved by passing the periphery of the valve portion 50 and venting through the exhaust path 53.

As pilot pressure from passage 42 is allowed to dump to atmosphere, the pressure acting on the main valve 25 moves the same into its opened position which communicates the air pressure supply with the piston 24 to drive the same through its drive stroke together with the fastening driving element 26. The fastener driving element 26 moves a fastener which has been moved into the drive track 18 from the magazine assembly 20 outwardly through the drive track 18 and into the workpiece.

After a fastener is driven, pressure is again supplied via line 44 to chamber 55 which returns the valve member 34 to its inoperative position ready for another cycle.

It can be seen that the quick exhaust valve structure of the invention provides quick exhaust of the pilot pressure chamber immediately at the tool, permitting the tool to cycle at its maximum performance rate. The only air volume that must be exhausted from the remote valve via the normally opened 3-way valve is the amount in the line 44 and under the valve member 34.

It thus will be appreciated that the objects of the invention have been fully and effectively accomplished. It will be realized, however, that the foregoing preferred embodiment of the present invention has been shown and described for the purpose of illustrating the structural and functional principles of the present invention and is subject to change without departure from such principles.

What is claimed is:

1. A remotely actuated fastener driving tool comprising:

a housing defining a fastener drive track and having a portion defining a reservoir chamber for storing supply air under pressure;

a fastener driving element carried by the housing for movement within the drive track through successive cycles of operation, each of which includes a fastener driving stroke and a return stoke;

a drive piston operatively connected with the fastener driving element for movement therewith;

a pilot pressure operated main valve movable from a normally closed position into an opened position allowing supply air to be communicated with the drive piston to initiate and effect the movement of the drive piston and fastener driving element through the fastener driving stroke thereof;

a magazine assembly carried by the housing for receiving a supply of fasteners and feeding successive fasteners into the drive track in a position to be driven into a work piece during successive fastener driving strokes of the fastener driving element; and valve structure carried by the housing, said valve structure including a valve member constructed and arranged to move from a normal, inoperative position into an operative position to initiate the movement of the main valve from its closed position to its opened position, said valve structure being constructed and arranged to be fluidly coupled to a remotely located source of air under pressure such that when air pressure is applied to said valve structure, said valve member is biased to the inoperative position thereof in sealing relation with an exhaust path defined in said valve structure, and when said air pressure is relieved from said valve structure, the valve member moves to the operative position thereof thereby opening the exhaust path permitting pilot pressure associated with the main valve to exhaust through the exhaust path initiating the fastener driving stroke.

2. A fastener driving tool according to claim 1, wherein said valve structure includes:

a valve housing sealingly engaged within a recess in said housing such that an upper surface of said valve member may be exposed to supply air, said valve member being mounted for movement within a portion of said valve housing, a control chamber being defined between the portion of said valve housing and a lower surface of said valve member, a first sealing member in sealing relation with said exhaust path when said valve member is in said inoperative position thereof, said first sealing member being in unsealed relation with said exhaust path when said valve member is in said operative position thereof, a second sealing member isolating said exhaust path from said reservoir chamber when said valve member is in said operative position thereof, said second sealing member permitting communication between said main valve and said reservoir chamber when said valve member is in the inoperative position thereof, and a third sealing member isolating said control chamber from said exhaust path, said control chamber being constructed and arranged to communicate with the remotely located source of air under pressure.

3. A fastener driving tool according to claim 2, wherein said valve structure further includes a spring member biasing said valve member to the inoperative position thereof.

4. A fastener driving tool according to claim 2, wherein said valve member is generally tubular and said first, second and third sealing members are each coupled to a periphery of the tubular valve member.

5. A fastener driving tool according to claim 4, wherein said valve housing includes a lower valve housing portion defining with said lower surface of s aid valve member, said control chamber, said lower valve housing being received in a portion of said valve housing such that said exhaust path is defined between an outer periphery of said lower valve housing portion and an inner periphery of said valve housing.

6. A fastener driving tool according to claim 5, wherein said lower valve housing portion is coupled to said valve housing by a pin connection.

7. A fastener driving tool according to claim 5, further including a connector coupled to said lower valve housing portion and in fluid communication with said control chamber, said connector being constructed and arranged to be coupled to tubing so as to communicate the remotely located source of air under pressure with said control chamber via the tubing.

8. A fastener driving tool according to claim 7, wherein said connector is press-fitted in a recess defined in said portion of said valve housing.

9. A quick exhaust valve structure for a remotely actuated fastener driving tool, the tool including a housing defining a fastener drive track and having a portion defining a reservoir chamber for storing supply air under pressure; a fastener driving element carried by the housing for movement within the drive track through successive cycles of operation, each of which includes a fastener driving stroke and a return stoke; a drive piston operatively connected with the fastener driving element for movement therewith; a pilot pressure operated main valve movable from a normally closed position into an opened position allowing supply air to be communicated with the drive piston to initiate and effect the movement of the drive piston and fastener driving element through the fastener driving stroke thereof; and a magazine assembly carried by the housing for receiving a supply of fasteners and feeding successive fasteners into the drive track in a position to be driven into a work piece during successive fastener driving strokes of the fastener driving element, the valve structure comprising:

a valve housing constructed and arranged to be carried by said housing;

a valve member mounted for movement within the valve housing so as to be movable between a normal, inoperative position and an operative position;

an exhaust path defined in said valve housing; and a connector carried by said valve housing and in fluid communication with the valve member, said connector being constructed and arranged to be coupled to a remotely located source of air under pressure such that when said valve structure is carried by the tool and air pressure is applied to said valve structure through said connector, said valve member is biased to the inoperative position thereof in sealing relation with said exhaust path, and when said air pressure is relieved from said valve structure through said connector, the valve member moves to the operative position thereof thereby opening said exhaust path permitting pilot pressure associated with the main valve to exhaust through the exhaust path initiating the fastener driving stroke.

* * * * *